United States Patent [19]

Arter et al.

[11] Patent Number: 4,477,068

[45] Date of Patent: Oct. 16, 1984

[54] AUTOMATIC DUPLEX DOCUMENT FEEDER

[75] Inventors: Nelson K. Arter; Dennis C. Estabrooks, both of Longmont; William G. Jackson, Boulder, all of Colo.

[73] Assignee: International Business Machines Corporation, Armonk, N.Y.

[21] Appl. No.: 393,283

[22] Filed: Jun. 29, 1982

[51] Int. Cl.[3] ..... B65H 9/06; B65H 9/16; B65H 29/20

[52] U.S. Cl. ..... 271/186; 271/236; 271/245; 271/251; 271/4; 271/DIG. 9; 271/65; 271/184; 355/14 SH

[58] Field of Search ..... 271/186, 236, 245, 248, 271/250, 251, 3, 3.1, 4, DIG. 9, 246, 65, 273, 274, 184; 226/21-23; 355/3 SH, 14 SH

[56] References Cited

U.S. PATENT DOCUMENTS

| | | | |
|---|---|---|---|
| 2,888,261 | 5/1959 | Barnes | 271/251 |
| 3,176,980 | 4/1965 | Mitchell et al. | 271/251 |
| 3,666,262 | 5/1972 | Fowler et al. | 271/DIG. 9 |
| 4,052,054 | 10/1977 | Cardwell et al. | 271/251 |
| 4,066,252 | 1/1978 | Wick | 271/DIG. 9 |
| 4,176,945 | 12/1979 | Hochauser et al. | 271/65 |
| 4,285,512 | 8/1981 | Shlatz | 271/251 |
| 4,300,758 | 11/1981 | Peter | 271/184 |
| 4,335,954 | 6/1982 | Phelps | 271/251 |
| 4,359,219 | 11/1982 | Garavuso | 271/251 |

FOREIGN PATENT DOCUMENTS 0002878 7/1979 European Pat. Off. ..... 271/251

OTHER PUBLICATIONS

IBM Tech. Disc. Bull. "Document Aligner System", Flavin, vol. 20, No. 2, Jul. 1977.

IBM Tech. Disc. Bull. "Document Aligning Device . . . ", Gutteling, vol. 16, No. 11, Apr. 1974.

IBM Technical Disclosure Bulletin, vol. 22, No. 11, Apr. 1980, "Document Reverser/Handler for Duplex Copying", A. H. Ett, pp. 5140-5141.

*Primary Examiner*—Duane A. Reger
*Assistant Examiner*—James E. Barlow
*Attorney, Agent, or Firm*—C. E. Rohrer

[57] ABSTRACT

A document feeder for automatically inverting a duplexed original so that the second side may be copied. The inverting mechanism is a turnaround roll located at the exit of the copy station. The inverting mechanism cooperates with rollers located above the document glass for moving documents thereacross. The rollers are inclined at an angle to the direction of paper movement in order to position paper against a side reference edge. When receiving a document from the turnaround roll and moving it in the reverse direction, the inclination of the rollers is removed or altered to a minus angle. Alternatively, a second set of rollers, inclined at a minus angle, are brought into active use when documents are moved in the reverse direction.

8 Claims, 8 Drawing Figures

AUTOMATIC DUPLEX DOCUMENT FEEDER

This invention relates to a document feeding device and more particularly to a document feeder which enables the automatic copying of both sides of an original document.

BACKGROUND OF THE INVENTION

Many document copying machines require that a document be held in a stationary manner face down on a document glass in order to be copied. Frequently, in a copier of this type, it is necessary for the operator to place the document on the document glass manually. However, in some machines, the operator may feed documents onto the document glass by inserting them one at a time into an automatic feeding arrangement. Mechanisms of this type are known as semiautomatic document feeds (SADF). In other machines, the operator may place a stack of documents upon a feed tray from which they are automatically fed. Mechanisms of this second type are known as automatic document feeds (ADF). Other document copying machines require that the document move across a narrow slit type viewing station whereat the moving document is scanned by stationary optics.

Whether a stationary or moving document copier is used, and whether a semiautomatic document feed or an automatic document feed is utilized, it is necessary for the feeder to provide mechanisms which move the paper across the document glass. A particularly useful type of forwarding mechanism is a system of rollers which in the case of a stationary document copier bear against the document glass as shown in U.S. Pat. No. 4,285,512, incorporated herein by reference. In this patent, the forwarding rollers may be made of a foraminous material positioned above the document glass at a slight angle, about 3°, to the direction of document movement in order to move the side of the document into a sliding relationship with a reference edge during the forwarding operation. The angle is produced by a curved drive shaft.

While the document feed of the above-mentioned patent is a reliable and convenient mechanism for copying original documents, it copies one side of the original document only before exiting that document to an exit pocket. Consequently, if it is desired to copy both sides of a duplexed original, it is necessary for the operator to remove the document from the exit pocket, place it on the ADF tray or enter it into the SADF, in either case with the opposite side down. In performing this operation, there is some potential for operator error since the wrong side might be copied or the operator might turn the copy so that it is copied end for end. In addition, it requires a manual operation which can be inconvenient. After the copy is made and the original exits the document glass, the operator then has the added inconvenience of manually turning the original over in order to preserve correct order in a set of duplexed originals. It is the general object of this invention to improve the document feed device described in the above-named patent by providing mechanisms which automatically copy a duplexed original document before exiting the document.

SUMMARY OF THE INVENTION

Briefly stated, this invention relates to method and means for automatically copying both sides of a duplex original in a document copying operation by providing a turnaround roll and associated guides at the exit of the document feed to receive documents which have been copied and in the case of a duplexed original, to feed it around the turnaround roll and back onto the document glass in order to copy the reverse side. Rollers along the edge of the document glass are operated to move the document rearwardly until it is completely positioned on the document glass. At that point, rollers are operated in a forward direction to position the document for copying the second side. Angular inclination of the rollers is present for the forwarding operation to keep the document positioned against a side reference edge. That inclination is removed for the reverse operation.

In one preferred embodiment, two sets of rollers are used. A first set is used to forward the document to the registration position and a second set to move the document in a reverse direction. When either set is in operation, the other set is moved out of the paper path. Preferably, the second set of rollers is positioned at a slight angle to the reverse direction of document movement in order to keep the side of the document in sliding relationship with the reference edge during the reverse operation.

In a second preferred embodiment, one set of bidirectional rollers is used and when operating to move the document in the reverse direction, the rollers are shifted so that the usual 3° inclination of the rollers to move the document into the reference edge is eliminated or altered even further to an angle which moves the document toward the reference edge when the document is in reverse movement.

BRIEF DESCRIPTION OF THE DRAWINGS

The above-mentioned and other features and objects of this invention and the manner of attaining them will become more apparent and the invention itself will best be understood by reference to the following description of embodiments of the invention taken in conjunction with the accompanying drawings, the description of which follows.

DETAILED DESCRIPTION

Figure 1:
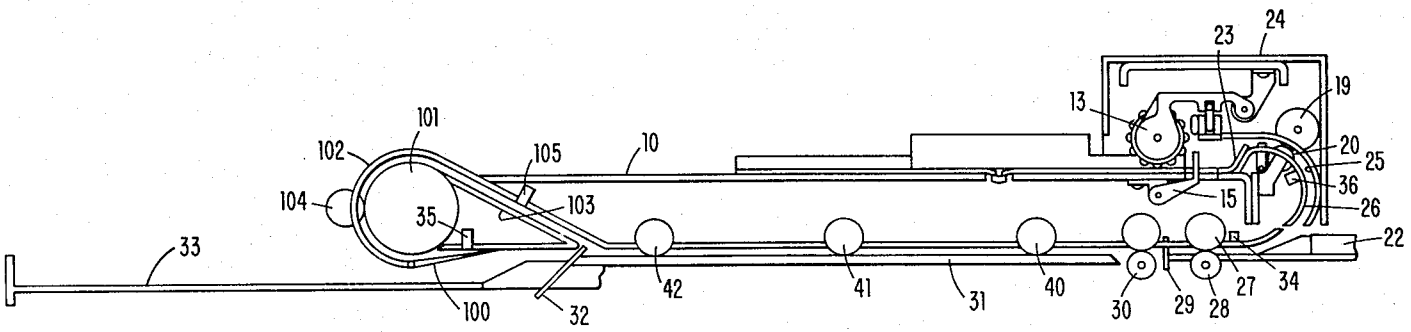
FIG. 1 is a profile view of the document feeding mechanism showing rollers positioned in relation to the document glass and a turnaround roll for receiving documents and moving them onto the document glass.

FIG. 1 is a profile view of a document feeder with an ADF and an SADF through which an operator can move documents onto the document glass 31 of a copying machine. In using the ADF mechanism, the operator places a stack of documents onto ADF tray 10 and moves the stack under the paper feed wheel 13 to a gate 15 where presence of the stack is sensed by a switch, not shown. Operation of the switch causes the gate 15 to drop out of the feed path and a paper feed wheel 13 begins rotation and drops onto the topmost sheet of the document stack. Contact between the feed wheel 13 and the topmost sheet moves that sheet up the ramp 23 across the opening between paper guide 25 and restraint pad 24 into the nip of rotating rollers 19 and 20. Once the topmost sheet is within the nip of rollers 19 and 20, it is moved around a 180° bend formed by paper guides 25 and 26 and into the nip of aligning rollers 27 and 28. From there the paper passes over a retracted entry gate 29 into the influence of pinch rollers 30. These rollers move the paper onto document glass 31 where motion across the glass is continued by a succession of foraminous rollers 40, 41, and 42. These rollers ultimately move the paper against the positioning gate 32 and then, by reversing rollers 40, 41, and 42, the paper is moved a slight distance away from positioning gate 32 to a registration position. After a copy has been made, positioning gate 32 is retracted and rollers 40, 41, and 42 move the copy paper to the exit tray 33.

FIG. 1 also shows SADF tray 22 which the operator may utilize to pass one sheet of paper into aligning rollers 27 and 28 against raised entry gate 29. At the proper time in the copying machine cycle, entry gate 29 retracts and the document is fed by rollers 27 and 28, pinch rolls 30, and foraminous rollers 40, 41, and 42 across the document glass 31 to the positioning gate 32. The document is backed away from the gate 32 for the copying operation and at its conclusion exit gate 32 is retracted and the document is fed into exit tray 33.

The operation of the device is as follows. When feeding a single sheet by utilizing the SADF, the operator places a single document face down onto SADF tray 22. The operator pushes the document forward into the area of aligning rolls 27 and 28. Entry sensor 34 registers the presence of the document and turns on aligning rolls 27 and 28 which are preferably driven by their own separate motor. The aligner rollers are driven for a sufficient time period to enable the document to be registered against the entry gate 29. After registration, the entry gate 29 is lowered through the use of a solenoid, not shown, and the foraminous rollers 40–42 are started. The document is then fed by these rollers from the entry tray 22 across the document glass platen 31. The aligner rolls are stopped and the entry gate 29 is reset by a trailing edge sensor signal generated as the document leaves the entry sensor 34. Meanwhile, the foraminous rollers continue running for a sufficient time to feed the document to the positioning gate 32. The gate 32 is dropped by a solenoid, not shown, either after the document has been imaged or during the copying process. After imaging is complete, the foraminous rollers 40–42 are restarted to feed the document into the exit tray area 33.

When the automatic document feed is being utilized, the operator places a stack of documents face up onto the tray 10 and pushes the stack against the gate 15 which activates a switch, not shown. Preferably, feeding of the documents is initiated when the operator presses the machine start button. Since the ADF switch has been activated, machine logic is enabled to discriminate between ADF operating mode and manual mode and thus the need for a special ADF mode start button is eliminated.

Upon actuation, the ADF gate 15 is dropped through solenoid action and the feed wheel 13 is turned on to move the first paper into nip rollers 19 and 20. Nip sensor 36 is located at the nip and when paper is sensed, dynamic braking is applied to the drive motor for the feed wheel 13 thus stopping the feed wheel quickly. Thereupon, the feed wheel 13 is lifted from the document stack by solenoid action and the nip roll drive motor is restarted together with the aligner roll motor. The entry and exit gates drop and the motor driving the foraminous rollers is started. The exit gate 32 is restored after a short preset time interval after enabling any document inadvertently left on platen 31 to exit the platen. The entering document is fed around turnaround guides 25 and 26 to aligner rolls 27 and 28. As the document leading edge makes the entry sensor 34, a timer is set to stop the foraminous roll motor after a time delay just long enough to allow the document to have reached the positioning gate 32 whereupon the foraminous roll motor is reversed to back the document a slight distance away from gate 32. When the document trailing edge moves past nip sensor 36, the feed wheel 13 is dropped onto the paper stack to feed the next document into the nip rollers 19 and 20, where it is sensed by the nip sensor 36 causing the feed wheel 13 to stop. When the document trailing edge drops the entry sensor 34, the aligner rolls 27 and 28 are stopped and the entry gate 29 is restored.

After the document is copied, the exit gate 32 is dropped and the foraminous roll drive is restarted to move the document from the platen 31. As the document leading edge reaches the exit sensor 35, the feed motor and the aligner roll motor are restarted. The entry gate 29 is dropped and the second document begins feeding around the turnaround guides 25 and 26 to repeat the cycle. The exit gate 32 is closed after a preset time interval and the foraminous rolls are run for a sufficient time to stop the second document on platen 31. The above-mentioned steps continue to repeat until the last document in the stack has been copied and exited.

In order to allow the documents to move into the exit tray 33, a solenoid operated deflector mechanism 100 is positioned as shown in FIG. 1. However, if it is desired to automatically copy duplex originals according to the operation of this invention, a duplex original mode is selected so that, upon completion of copying a first side, the deflector 100 is moved such that documents exiting the document glass 31 are moved by the foraminous rollers 40–42 into the area of influence of turnaround roll 101. That roll, together with roll 104, and its associated guides 102 and 103, move the document back onto the document glass 31. With certain modifications explained below, rollers 40–42 may be operated in the reverse direction so that the document is moved across document glass 31 until it is completely out of the turnaround mechanism and located on the glass 31. This condition is provided when the trailing edge of the document passes photosensor 105 setting a timer to continue the operation of rolls 40–42 until the trailing edge of the document is completely on document glass 31. At that time, the rolls 40–42 are again operated in the forward direction to move the document to the positioning gate 32 so that the second or reverse side can be copied.

When the copying operation is complete, the document is again fed around the turnaround mechanism and back onto the document glass. At that point, rolls 40–42 are again operated in the forward direction, the deflector 100 is moved into the position shown in FIG. 1 and the document is fed onto exit tray 33. By utilizing the turnaround mechanism a second time after completion of copying of the second side, the document is inverted to its original position so that the stack of copied originals is in correct order on the exit tray 33.

While the basic operation of the mechanism has been described with reference to FIG. 1, a problem results in the rotation of rolls 40–42 in the reverse direction since these rolls are canted at an angle of about 3° in order to move documents into a reference edge when the rolls are rotated in a forward direction. As a consequence, when operated in a reverse direction, these rolls move the document away from the reference edge and if they are simply reversed, the paper would be moved away from the reference edge until the paper escapes contact with the rolls. At that point, further movement of the paper would not be possible and a trouble signal would have to be activated to alert the operator to take corrective action. Consequently, in order to accomplish the duplex operation of this invention, the inventors have provided two alternative embodiments shown in FIGS. 2 and 4 which provide for reverse movement of the document to be copied without incurring loss of ability to move the sheet.

Figure 2:
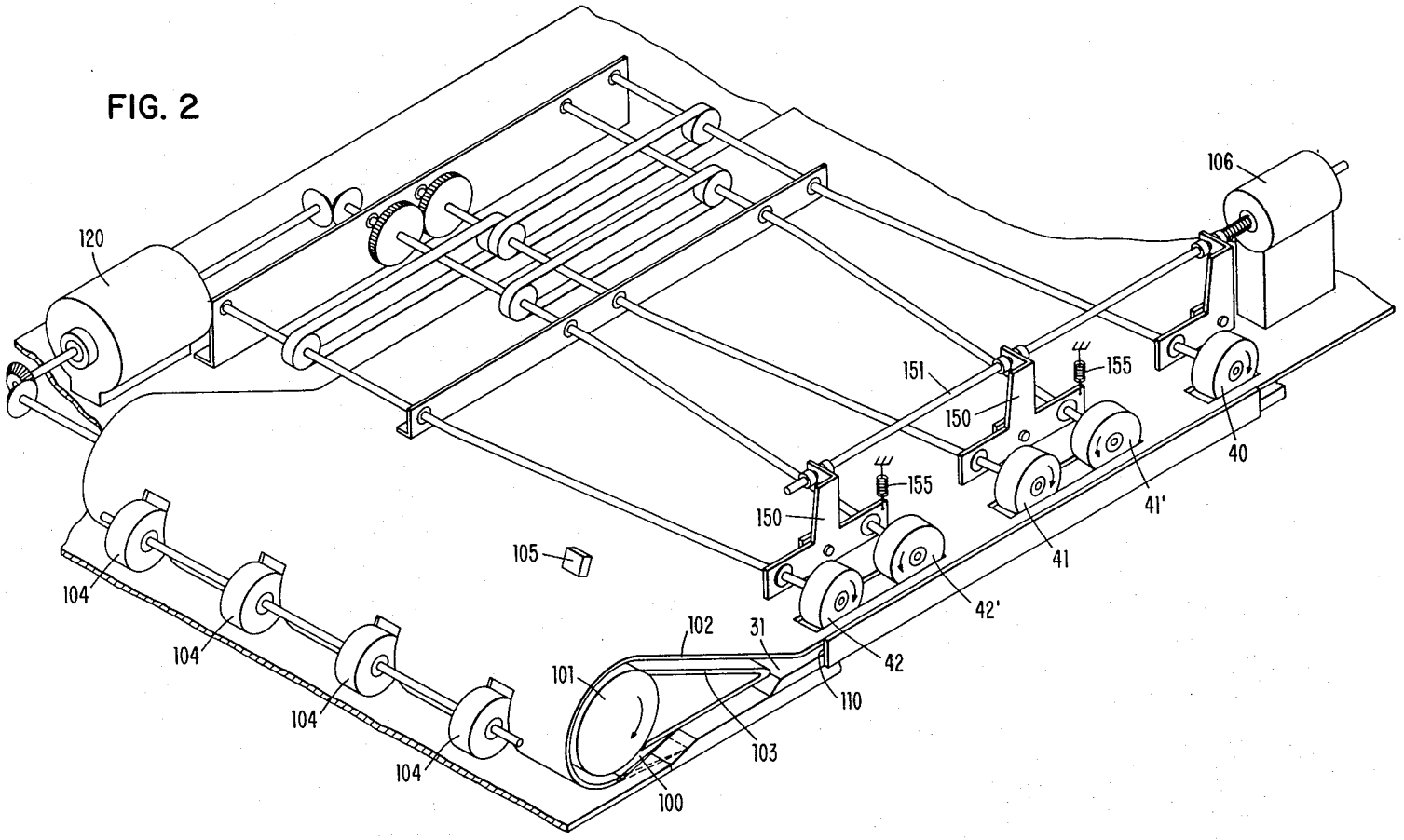
FIG. 2 is a perspective view showing the first embodiment of the invention.

The embodiment shown in FIG. 2 provides a second set of rolls which rotate in the reverse direction and which are out of contact with the paper until the leading edge reaches a photosensor 105. When sensor 105 is activated, a signal is sent to energize solenoid 106 which lifts the three forward drive document feed rollers 40–42 off the document glass and drops the two duplex backward feed rollers 41' and 42' onto the document glass. The document continues to move in the reverse direction under the influence of rollers 41' and 42' until the trailing edge of the document is well past the turnaround guides 102 and 103. Note that rollers 41' and 42' are skewed at an angle of approximately −3° to keep the edge of the document registered against the document glass reference edge 110. At this point, the document is ready for leading edge registration and the copying operation. To accomplish this, the solenoid 106 is deactivated so that the three forward drive feed rollers 40–42 are repositioned in contact with the paper and rollers 41' and 42' are lifted off the paper. After the copying operation is complete, the document is again fed around the turnaround roll and back onto the document glass through operation of rollers 41' and 42'. Again solenoid 106 is deactivated and rollers 40, 41, and 42, are activated to exit the paper to exit tray 33. This second trip through the turnaround system is used to insert the paper to its original orientation in order to keep a stack of original documents in the proper order. Note that all rollers are driven by motor 120.

Figure 3:
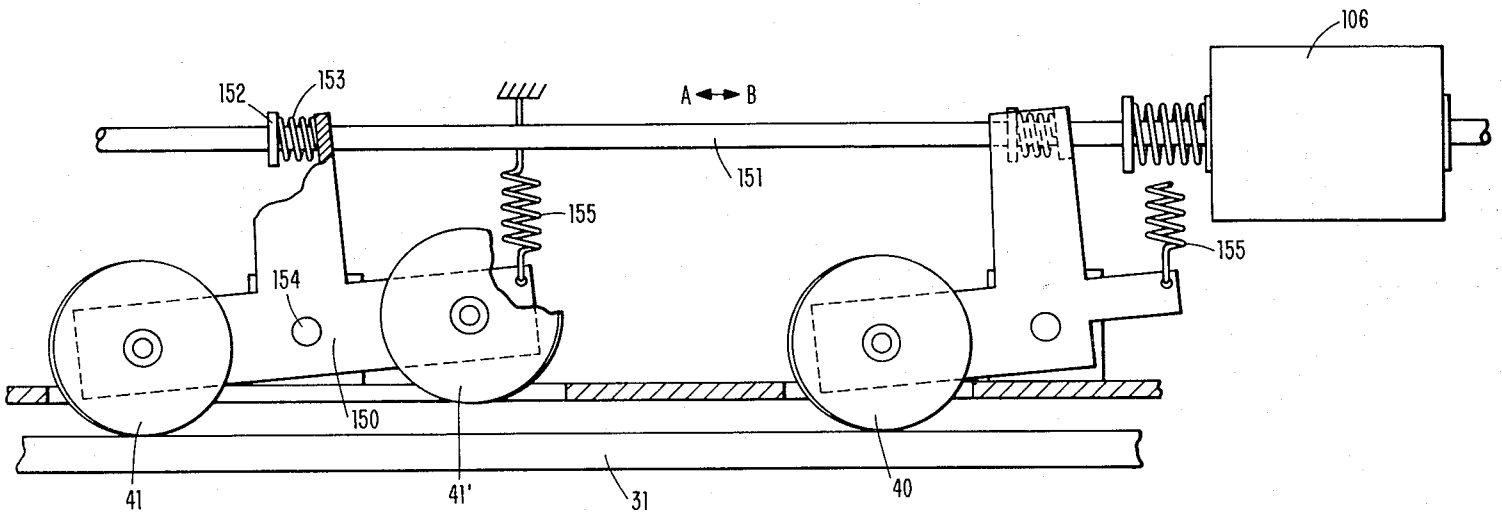
FIG. 3 is a diagrammatic detail view of the roller positioning mechanism used in the embodiment of FIG. 2.

FIG. 3 is a detailed diagrammatic view of the mechanism used to shift rollers 41 and 41' to and from contact with a document located on document glass 31. Rollers 41 and 41' are positioned near opposite ends of a pivoted T-bar 150. The arm 151 operated by solenoid 106 extends through a slot in T-bar 150 and onto a similar T-bar mechanism for adjusting the position of roller pair 42 and 42'. Collar 152 is secured to arm 151 so that, upon energization of solenoid 106, arm 151 is moved in direction B resulting in a compression of spring 153 and a rocker movement of T-bar 150 around its pivot 154 so that roller 41' is brought downwardly into contact with document glass 31 and roller 41 is rocked upwardly out of such contact.

When it is desired to reposition the forward moving roller 41 in contact with document glass 31, solenoid 106 is deenergized thus relaxing spring 153 allowing spring 155 to rock T-bar 150 around pivot 154 so that roller 41' is lifted off the document glass 31 and roller 41 is repositioned thereon.

Figure 4:
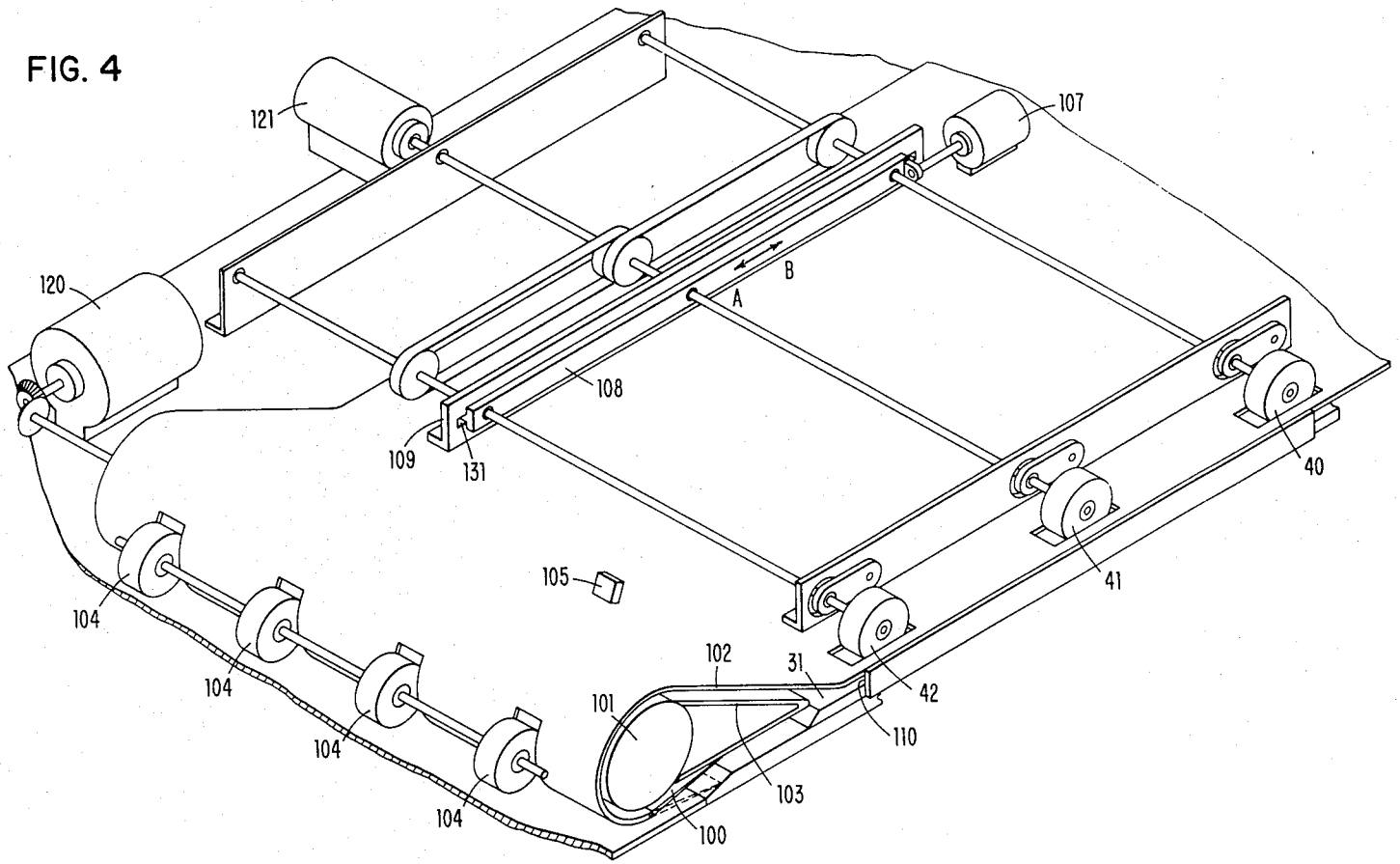
FIG. 4 is a perspective view showing a second embodiment of the invention.

FIG. 4 shows a second embodiment of the invention. As explained above, if the operator has selected the duplex original mode, after the first side is copied, the deflector 100 changes position thus allowing paper exiting the document glass to move around the turnaround roll 101 through turnaround guides 102 and 103 and back onto the document glass 31. Sensor 105 is activated by the document leading edge to signal the energization of a solenoid 107 which thereupon moves the sliding link 108 in the direction B within bracket 109 in order to straighten out the normally curved shafts which drive rolls 40, 41, and 42. Through this operation, the +3° angle of the rollers to document movement is removed and consequently paper moving in the reverse direction on document glass 31 is not moved either toward or away from the reference edge 110. If preferred, the sliding link 108 can be moved further to establish an angle of −3° for rollers 40, 41, and 42 so that the documents are kept in sliding relation with reference edge 110 throughout the reverse movement. Again, the paper is moved well past the turnaround guides 102 and 103 before rollers 40–42 are stopped. At this point, the document is ready for leading edge registration and copying of the second side. To accomplish this, the solenoid 107 is deenergized to move the sliding link 108 in direction A to its original position thus reestablishing rollers 40–42 at a positive angle of 3° to the reference edge 110. Rollers 40–42 are then rotated in the forward direction to again register the document for the copying operation. After the copying operation is complete, the document again passes around the turnaround roll and back onto the document glass before it is exited to the exit tray. In that manner, a stack of documents on the exit tray is kept in the proper order. Note that motor 120 drives the turnaround roll 101 while reversing motor 121 drives the rollers 40, 41, and 42.

Figure 5A:
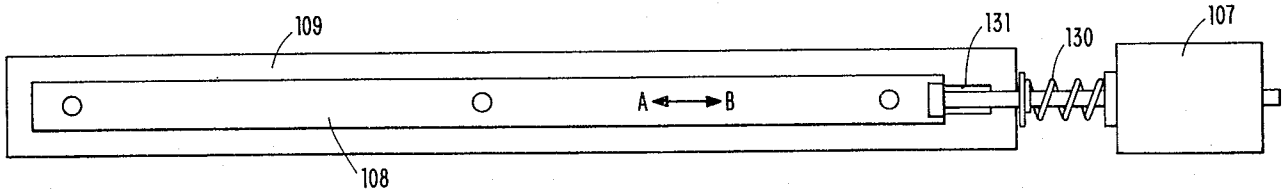
FIGS. 5*a* and 5*b* are diagrammatic detail views of the roller positioning mechanism used in the embodiment of FIG. 4.
Figure 5B:
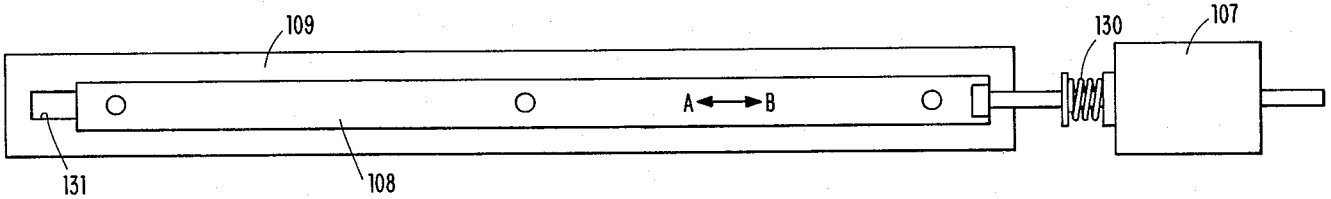

FIG. 5 shows a diagrammatic representation of the slide mechanism for shifting the rollers 40, 41, and 42 so that the angle of inclination to the direction of paper movement of those rollers is controlled. In the forward movement position, shown in FIG. 5A, solenoid 107 is deenergized allowing spring 130 to position slide 108 in direction A within slit 131 in bracket 109. When reverse movement is called for, solenoid 107 is energized to stretch spring 130 and move slide 108 in direction B.

Figure 6:
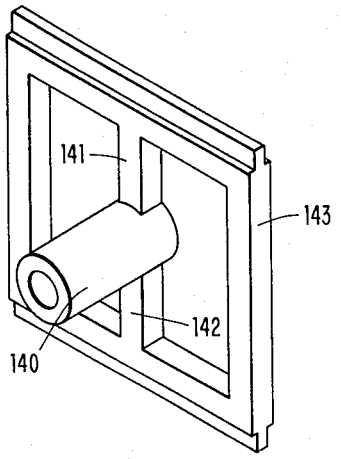
FIGS. 6 and 7 show the torsion bar suspension used for the bearing which supports the curved shafts used in both of the illustrated embodiments.
Figure 7:
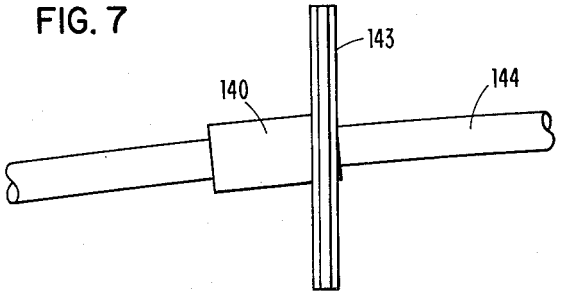

FIGS. 6 and 7 show the bearing used near rollers 40, 41, and 42 to support the curved shafts transmitting drive power to the inclined rollers. The bearing is self-aligning and includes a torsion bar suspension which applies a tension force to the curved shafts for removing vibration therefrom. FIG. 6 shows the bearing assembly with bearing 140 mounted between torsion bars 141 and 142 in support 143. FIG. 7 shows a top view of the bearing on a curved shaft 144, providing tension to the shaft through the torsion created in bars 141 and 142 by the angle of inclination. The bearing is used for both of the embodiments shown in FIGS. 2 and 4.

While the invention has been particularly shown and described with reference to a preferred embodiment thereof, it will be understood by those skilled in the art that other changes in form and details may be made therein without departing from the spirit and scope of the invention. For example, the invention has been described in the context of a machine which positions a document in a stationary position on a document glass for the copying operation. The invention, however, can also be used to advantage in a moving document copier where the document is fed across a viewing slit. Additionally, the angular inclinations of 3° and −3° to the direction of paper movement are representative of a particular embodiment and are used merely to illustrate the invention principle. Particular degrees of inclinations are not significant.

What is claimed is:

1. An automatic duplex document feed device for use on a document copier machine comprising:

a tray for holding a stack of documents to be copied;

document forwarding means including feed means to feed document sheets, serially, from said stack;

a document glass platen whereat said document is viewed for a copying operation;

guide means for receiving document sheets from said document forwarding means to direct said document sheets to said document glass platen;

a reference edge along one side of said document glass;

roller means to move said document sheets across said document glass platen in a first direction, said roller means inclined to the direction of travel of said document sheets to move said sheets into sliding relationship with said reference edge;

an exit tray to receive said document sheets exited from said document glass platen;

turnaround guides to receive said document sheets exited from said document glass platen;

diverter means to selectively divert said document sheets away from said exit tray and toward said turnaround guides;

turnaround feed means to move said document sheets through said turnaround guides and back onto said document glass, said document sheets thereby caused to traverse said document glass in a second direction opposite to said first direction;

roller inclination establishing means for altering said roller inclination to enable said set of rollers to move said document sheets in said second direction without moving said sheets substantially out of sliding relationship with said reference edge; and means for selectively positioning said roller inclination establishing means to establish a desired inclination of said set of rollers relative to the direction of sheet travel which includes a slide bar held within a slot in a fixed bracket, said slide bar containing mounts for shafts upon which said set of rollers are mounted.

2. The document feed device of claim 1 further including reversible drive means connected to drive said set of rollers in either of the first or second directions.

3. The document feed device of claim 1 wherein said set of rollers bears against said document glass in driving position whenever a document sheet is not present.

4. The document feed device of claim 1 further including an entry tray upon which document sheets are manually placed in a sequential manner for feeding said document sheets to said document glass platen.

5. A document feed device for use on a document copier machine comprising:

a document glass platen whereat documents to be copied are viewed for a copying operation;

a reference edge along one side of said document glass;

roller means to move said document sheets across said document glass platen in a first direction, said roller means inclined to the direction of travel of said document sheets to move said sheets into sliding relationship with said reference edge;

an exit tray to receive said document sheets exited from said document glass platen;

turnaround guides to receive said document sheets exited from said document glass platen;

diverter means to selectively divert said document sheets away from said exit tray and toward said turnaround guides;

turnaround feed means to move said document sheets through said turnaround guides and back onto said document glass, said document sheets thereby caused to traverse said document glass in a second direction opposite to said first direction;

roller inclination establishing means for altering said roller inclination to enable said set of rollers to move said document sheets in said second direction without moving said sheets substantially out of sliding relationship with said reference edge; and means for selectively positioning said roller inclination establishing means to establish a desired inclination of said set of rollers relative to the direction of sheet travel including a slide bar held within a slot in a fixed bracket, said slide bar containing mounts for shafts upon which said set of rollers are mounted.

6. The document feed device of claim 5 including reversible drive means connected to drive said set of rollers in either of the first or second directions.

7. The document feed device of claim 5 wherein said set of rollers bears against the document glass in driving position whenever a document sheet is not present.

8. The document feed device of claim 5 further including an entry tray upon which document sheets are manually placed in a sequential manner for feeding said document sheets to said document glass platen.

* * * * *